US005862817A

United States Patent [19]

Lee

[11] Patent Number: 5,862,817

[45] Date of Patent: Jan. 26, 1999

[54] TWO-IN-ONE TOOTH BRUSH UNIT

[76] Inventor: Kenten Lee, 5F, No. 8-37, Lung Hsing Rd., Pa Li, Taipei Hsien, Taiwan

[21] Appl. No.: 988,960

[22] Filed: Dec. 11, 1997

[51] Int. Cl.[6] ..... A46B 11/00; A46B 9/04; A45D 44/18; A45D 40/24

[52] U.S. Cl. ..... 132/311; 132/309; 132/314; 15/167.1

[58] Field of Search ..... 132/309, 311, 132/314; 15/167.1, 184; 401/175, 184

[56] References Cited

U.S. PATENT DOCUMENTS

| | | | |
|---|---|---|---|
| 4,071,300 | 1/1978 | Nichols et al. | 401/175 |
| 4,503,871 | 3/1985 | Mendenhall | 132/84 B |
| 4,530,129 | 7/1985 | Labick et al. | 15/184 |
| 4,866,809 | 9/1989 | Pelletier | 15/167.1 |
| 5,584,593 | 12/1996 | Lafortune | 401/184 |

*Primary Examiner*—John J. Wilson
*Assistant Examiner*—Trang Doan
*Attorney, Agent, or Firm*—Rosenberg, Klein & Bilker

[57] ABSTRACT

The subject matter relates to a two-in-one tooth brush unit, comprising a tooth brush and tooth paste, featuring an accommodating hole on the handle of the tooth brush, so the tooth paste can be accommodated in the accommodating hole on the brush handle, while the accommodating hole on the handle and the tooth paste can be wrapped by an adhesive paper label; so configured to achieve functions such as; more convenient packaging process, precludes the unit from being recovered for reuse, disposal of the tooth paste and the tooth brush as one unit, adheres to environmental protection requirements, etc.

1 Claim, 5 Drawing Sheets

TWO-IN-ONE TOOTH BRUSH UNIT

BACKGROUND OF THE INVENTION

The subject matter relates to a two-in-one tooth brush unit, particularly to a disposable tooth brush unit that is conveniently packaged to avoid it from being recovered for reuse, while the tooth paste and the tooth brush can be disposed of as one unit, in order to satisfy environmental protection requirements.

Conventionally, prior art of disposable tooth brush has been widely used in hotels, inns, and other organizations, since it can be disposed of after one use, it requires no consideration in terms of sanitary and health problems. A conventional disposable tooth brush is normally packed in a packaging bag, and since said type of tooth brush needs tooth paste in actual use, normally a tooth paste and a tooth brush are jointly packed in a packaging bag. But since the tooth paste and the tooth brush are two separate articles, they have to be put inside the packaging bag separately and the one article first put inside the bag will often interfere with the packaging process for the other article. This will cause much inconvenience in the packaging process, is time and labor consuming, and results in the production speed slowing down; but if the tooth paste and the tooth brush are packed separately, it will cost more in terms of working hours and costs. Furthermore, in case a dishonest hotel serviceperson tries to recover the used brush for reuse, there are sanitary concerns raised. And since a conventional disposable type of tooth brush and tooth paste are two separate articles which are disposed of separately after use, disposal does not satisfy environmental protection requirements.

Therefore, the conventional type of disposable tooth brush involves inconvenience and shortcomings that need improvement.

In order to seek possible improvement on the above shortcomings, the subject inventor has devoted time on research, with technical applications, and has finally presented a reasonably designed subject matter with effective improvement on the above shortcomings.

SUMMARY OF THE INVENTION

The primary objective of the subject matter is to present a type of two-in-one brush unit, comprising a tooth brush and a tooth paste, on the brush handle is an accommodating hole, so the tooth paste can be inserted inside the accommodating hole on the brush handle, by combining the tooth brush and the tooth paste as one unit, with the tooth paste inserted in the brush handle, so the packing process can be finished in one operation, saving time and labor, enabling more convenient production. The accommodating hole on the brush handle and the tooth paste can be wrapped by a paper label to prevent dishonest servicepersons from recovering the used unit for reuse, and the tooth brush and the tooth paste can be disposed of as one unit, with the tooth paste being inserted in the accommodating hole, to satisfy environmental protection requirements.

To enable a better understanding of the characteristics and technical contents of the subject matter, please refer to the following detailed description with drawings:

| Brief Description of Numerals | |
|---|---|
| 10 brush | 11 paste |
| 12 handle | 13 brush head |
| 14 bristles | 15 accommodating hole |
| 16 package bag | 17 paper label |

DETAILED DESCRIPTION OF THE PREFERRED EMBODIMENT

Figure 1:
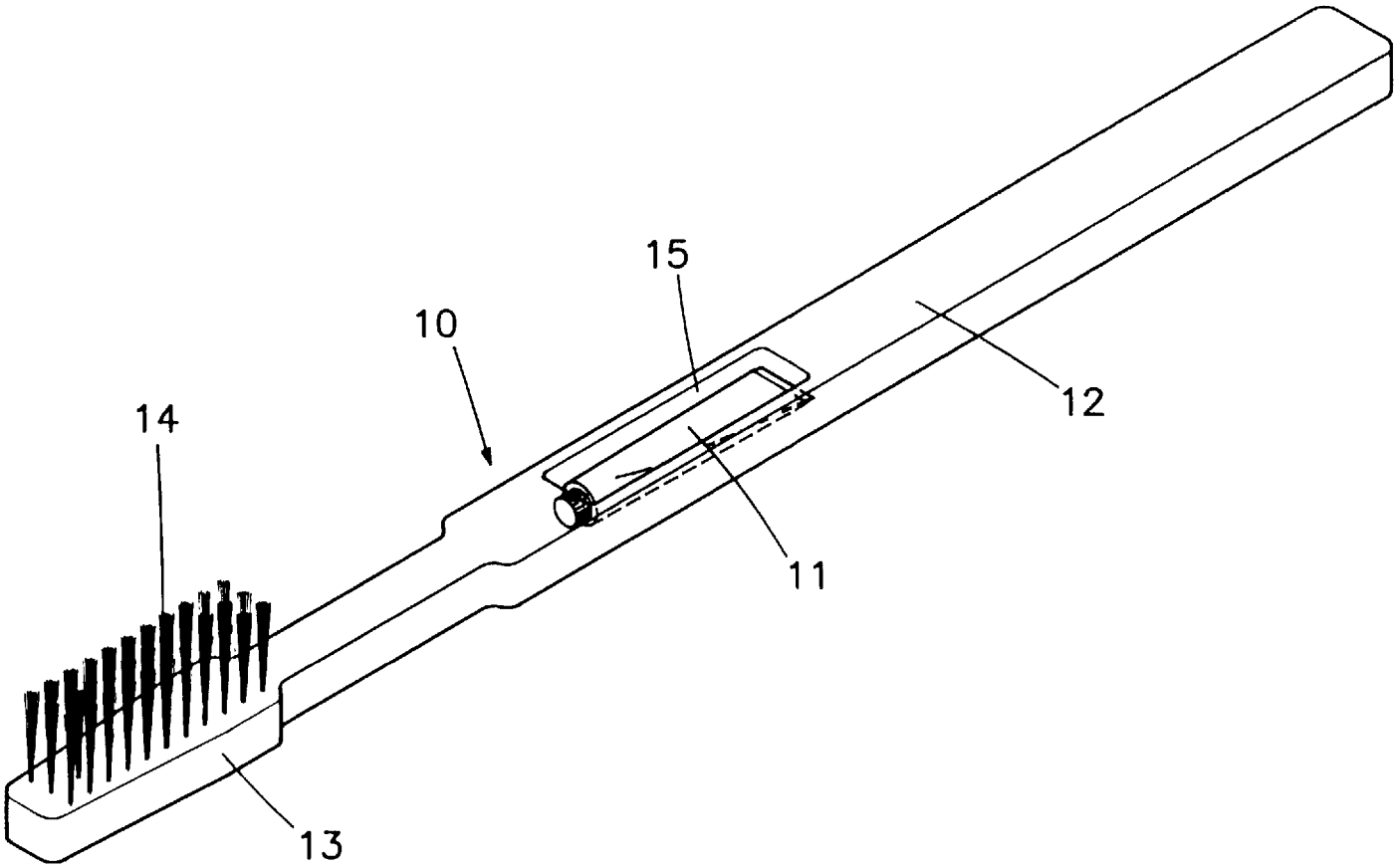
FIG. 1 is a perspective assembled view of the subject matter.
Figure 2:
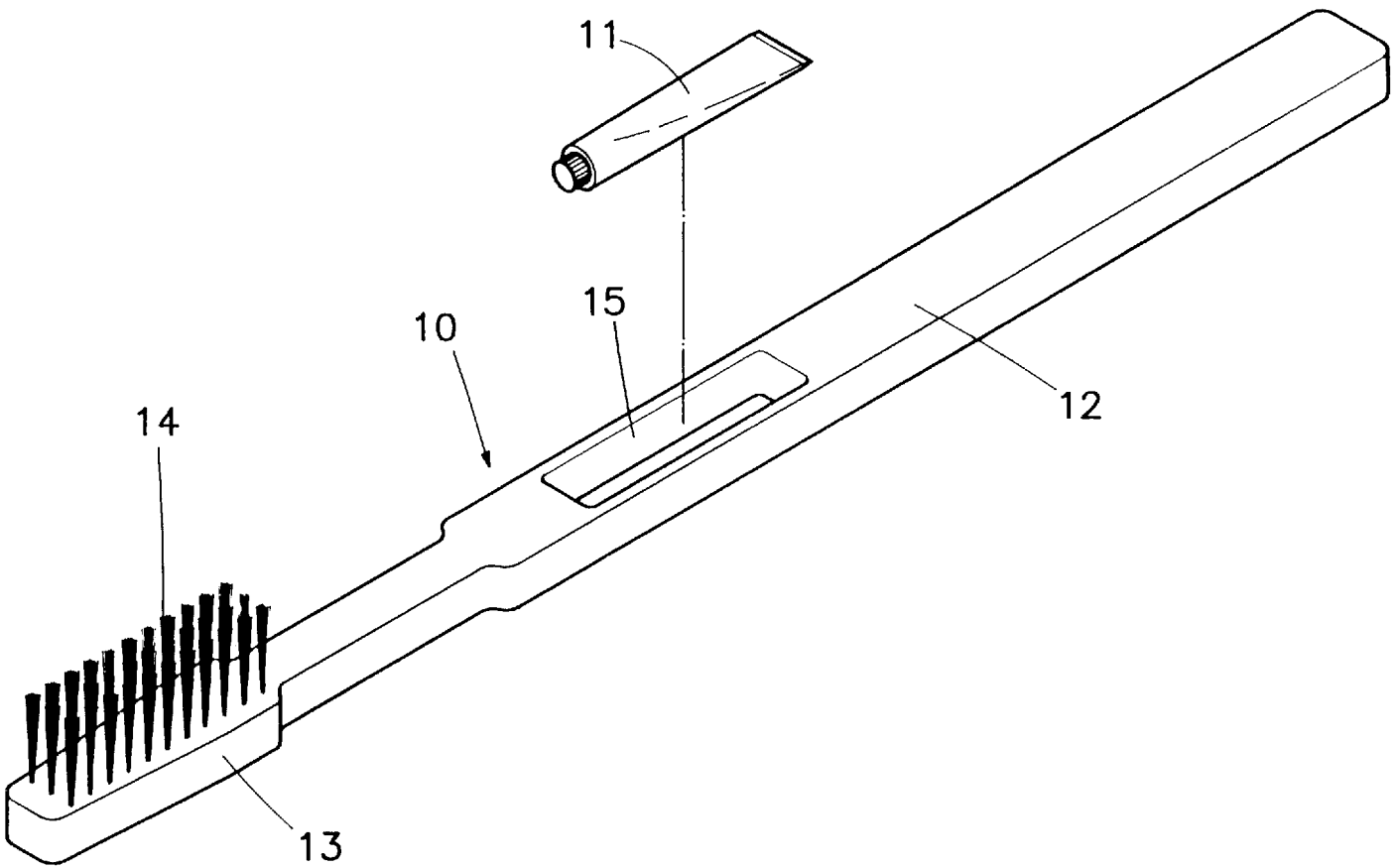
FIG. 2 is a perspective disassembled view of the subject matter.
Figure 3:
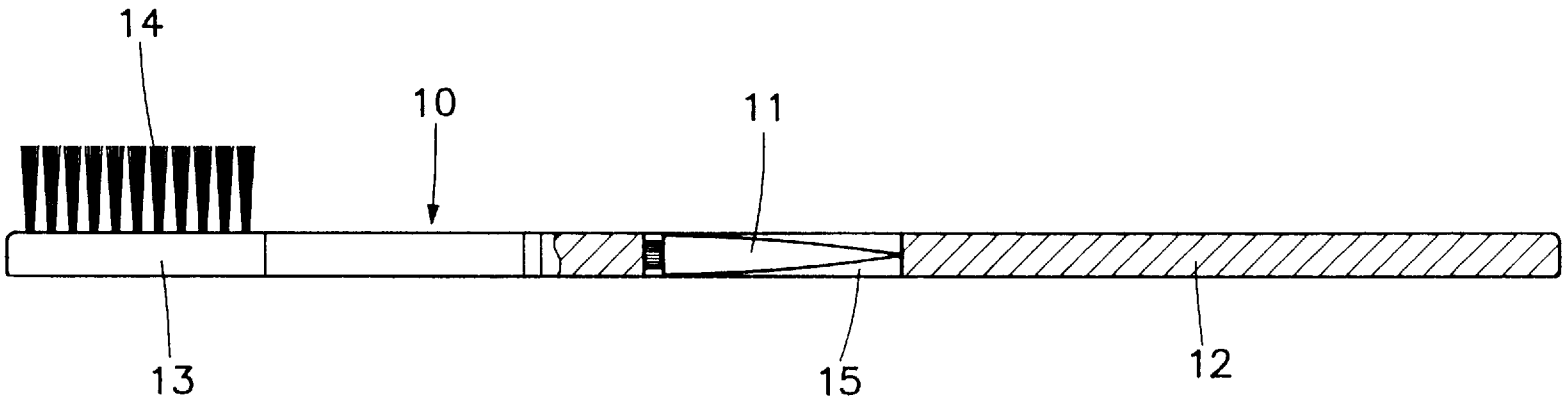
FIG. 3 is a plan sectional view of the subject matter.
Figure 5:
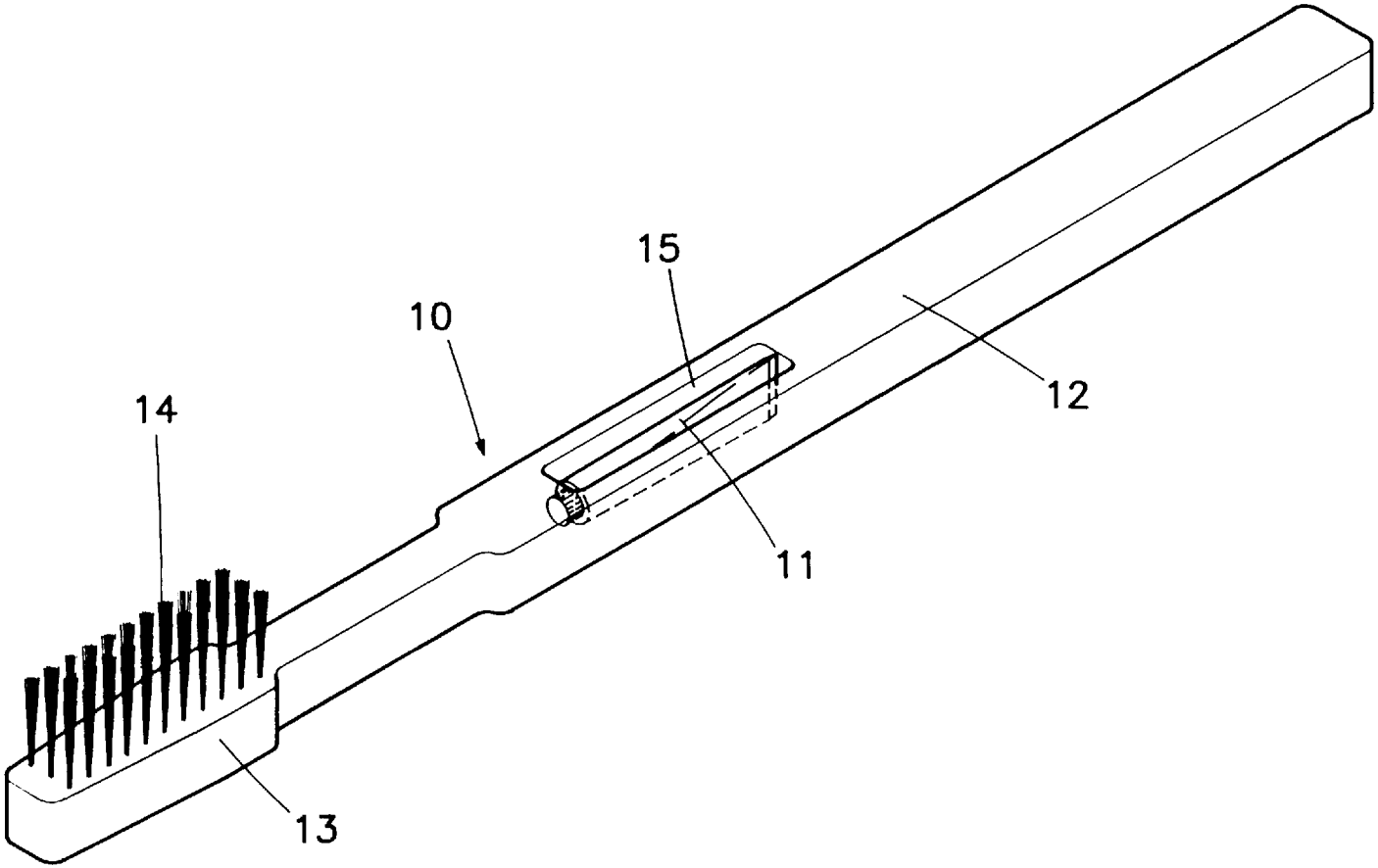
FIG. 5 is a perspective assembled view of another embodiment of the subject matter.

Please refer to FIGS. 1, 2 and 3 which are respectively a perspective assembled view, a perspective disassembled view and a plan sectional view of the subject matter. The subject matter relates to the presentation of a two-in-one toothbrush unit, particularly to a disposable type of toothbrush unit, comprising mainly a brush 10 and a paste 11 wherein the brush 10 comprises a brush handle 12, at the front end of the handle 12 is a brush head 13, on the brush head 13 are bristles 14; the subject matter features an accommodating hole 15 on the brush handle 12. The accommodating hole 15 is roughly shaped like the exterior of tooth paste 11, said paste 11 is accommodated in the accommodating hole 15 on the brush handle 12, thus comprising a two-in-one brush unit. To use the tooth paste 11, the user need only push the tooth paste 11 with a finger, the tooth paste 11 will be pushed out of the accommodating hole 15 on the handle 12. Moreover, the size of the accommodating hole 15 may be appropriately modified according to the inserting angle of the tooth paste 11 (as illustrated in FIG. 5).

Figure 4:
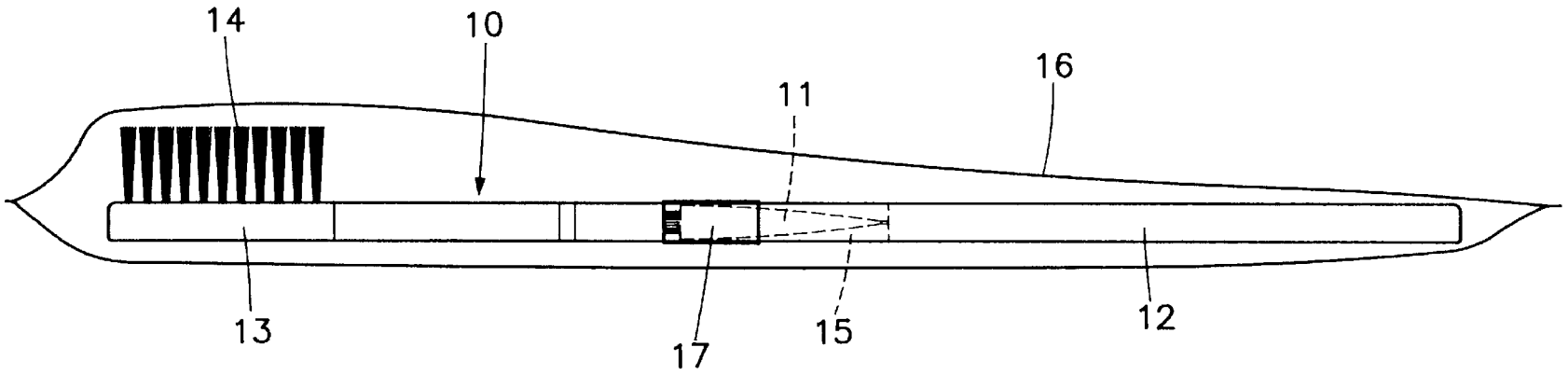
FIG. 4 is a plan view of the subject matter in a package.

Please refer to FIG. 4 which is a plan view of the subject matter in a package. Since the subject matter combine the tooth brush 10 and the tooth paste 11 into one unit, with the tooth paste 11 inserted inside the handle 12 of the tooth brush 10, it requires only one operation during the packaging process to put the tooth brush 10 and the tooth paste 11 into the package bag 16; such a single packaging process will save time and labor and the production process will be more convenient. Furthermore, a paper label 17 may be adhered around the outside of the tooth paste 11 and the accommodating hole 15 on the brush handle 12, which may serve as a protective sealing to avoid reuse of the brush. After the subject matter of tooth brush 10 and tooth paste 11 are used, the tooth paste 11 can be re-inserted in the accommodating hole 15 on the brush handle 12, so the tooth brush 10 and the tooth paste 11 can be disposed of as one unit, which will satisfy environmental protection requirements.

Summing up, the subject matter is indeed an improvement on the conventional type of disposable tooth brush and tooth paste which involve inconvenient packaging processes, reduced speed in production, the possibility of being recovered for reuse, inability to satisfy environmental protection requirements, etc., such a novel creation with its novelty and originality will fully satisfy the qualifications for a patent right, hence this application is filed in accordance with the Patent Law to protect the subject inventor's rights and interests. Your favorable consideration will be appreciated.

It is hereby declared that the above description, covering only the preferred embodiment of the subject matter, should not be used to limit or restrict the subject claim, and that all equivalent structural and/or configurational variations and/or modifications deriving from the subject description with drawings herein shall reasonably be included in the intent of the subject claim.

I claim:

1. A two-in-one tooth brush unit, comprising a tooth brush and tooth paste, said tooth brush including (a) a brush handle, said tooth brush handle having an accommodating hole formed therein for receiving said tooth paste in said accommodating hole, (b) a brush head located at one end of said brush handle, (c) a plurality of bristles disposed on said brush head and extending therefrom, and (d) an adhesive paper label wrapped around said accommodating hole of said brush handle and said tooth paste.

* * * * *